US005711128A

United States Patent [19]

Kordelin

[11] Patent Number: 5,711,128

[45] Date of Patent: Jan. 27, 1998

[54] METHOD FOR JOINING WALLBOARDS TOGETHER AND A NOVEL WALL ELEMENT

[75] Inventor: Tapio Kordelin, Turku, Finland

[73] Assignee: Oy Shippax Ltd., Turku, Finland

[21] Appl. No.: 737,245

[22] PCT Filed: Mar. 28, 1995

[86] PCT No.: PCT/FI95/00165

§ 371 Date: Nov. 14, 1996

§ 102(e) Date: Nov. 14, 1996

[87] PCT Pub. No.: WO95/33898

PCT Pub. Date: Dec. 14, 1995

[30] Foreign Application Priority Data

Jun. 6, 1994 [FI] Finland ..... 942654

[51] Int. Cl.[6] ..... B65B 47/00

[52] U.S. Cl. ..... 52/579; 52/588.1; 52/586.1; 403/331; 403/326

[58] Field of Search ..... 52/579, 588.1, 52/582.1, 582.2, 584.1, 587.1, 586.1; 403/331, 326, 329

[56] References Cited

U.S. PATENT DOCUMENTS

| | | | |
|---|---|---|---|
| 3,332,192 | 7/1967 | Kessler et al. | 52/586.1 |
| 3,469,873 | 9/1969 | Glaros | 52/588.1 X |
| 3,766,696 | 10/1973 | Totoonchie | 52/584.1 X |
| 4,138,808 | 2/1979 | Walkiewicz, Jr. | 52/586.1 X |
| 5,038,534 | 8/1991 | Pollock . | |
| 5,078,530 | 1/1992 | Kim | 403/331 X |
| 5,592,794 | 1/1997 | Tundaun | 52/582.1 X |

FOREIGN PATENT DOCUMENTS

| | | | |
|---|---|---|---|
| 0 324 209 | 7/1989 | European Pat. Off. . | |
| 24 53 196 | 5/1976 | Germany . | |
| 606 658 | 11/1978 | Switzerland . | |
| 850642 | 10/1960 | United Kingdom | 52/588.1 |

*Primary Examiner*—Creighton Smith

*Attorney, Agent, or Firm*—Burns, Doane, Swecker & Mathis, L.L.P.

[57] ABSTRACT

A wall element includes a wall panel with its first side edge bent into an L-section and the second side edge bent into a Z-section. The bent sections are provided with holes at specific intervals from each other along the height of the wall panel. When two panels are placed side by side so that the L-section of one panel is fitted against the Z-section of another panel, the holes are positioned opposite one another. A U-shaped tongue strip is fitted against the L-section of the panel, the tongue strip being provided with tongues shaped and dimensioned so that the tongues pass through the holes of the side edges of both panels. A U-shaped wedge strip is fitted against the Z-section of the panel, the wedge strip being provided with holes shaped and dimensioned so that the tongues pass through the holes. The panels attach to each other when the wedge strip is knocked downwards.

16 Claims, 3 Drawing Sheets

METHOD FOR JOINING WALLBOARDS TOGETHER AND A NOVEL WALL ELEMENT

FIELD OF THE INVENTION

The invention relates to a method for attaching wall panels to each other and a new wall element.

BACKGROUND OF THE INVENTION

According to a known method partition panels or wall elements, particularly in the installation of so-called cassettes used in shipbuilding, are attached to each other only at the floor and at the ceiling where the points of attachment can be protected with covering strips. The panels are not at all attached to each other in the middle because it would require separate protective strips to cover the points of attachment. The problem with this method of attachment is that gaps readily appear between the elements in the middle. Another problem is poor alignment of the elements which may lead to an uneven wall surface.

Various attachment mechanisms have also been suggested whereby the wall panels or elements can be attached to each other also in the middle or in practice over the entire height of the wall. These kinds of systems are often composed of various profiled strips which are, for example, placed against the edge of the panel or the element and are screwed fast at specific intervals. Therefore, attachment of these known profiled strips is in practice rather tedious.

SUMMARY OF THE INVENTION

The purpose of this invention is to eliminate the above problem and obtain a new method for attaching wall panels without the above drawbacks. The purpose of the invention is also to obtain a wall element comprising all tools needed in the attachment, the element being, according to the method, attachable to other similar elements.

By means of the invention wall panels can be firmly attached and accurately aligned with each other over the whole length of the panel. Installation is rapid because no screwing or the like is needed to be performed on the building site. The strips employed in the method have a simple structure and their manufacturing cost is low.

BRIEF DESCRIPTION OF THE DRAWING FIGURES

The invention will be described in the following referring to the enclosed drawings in which FIG. 1 shows wall panels attached to each other as a perspective view partly cross-sectioned, FIGS. 2A and 2B show the perforation of the edge sections of the wall panel, FIG. 3 shows the structure of a tongue strip, FIG. 4 shows the structure of a wedge strip, FIG. 5 shows wall panels fitted adjacently seen from above, FIG. 6 shows a cross-section of a joint along the line A—A of FIG. 5 before knocking down the wedge strip, FIG. 7 shows the joint of FIG. 6 after knocking down the wedge strip, FIG. 8 shows the structure of a wall element of wall panels placed against each other.

DETAILED DESCRIPTION OF THE INVENTION

Figure 1:
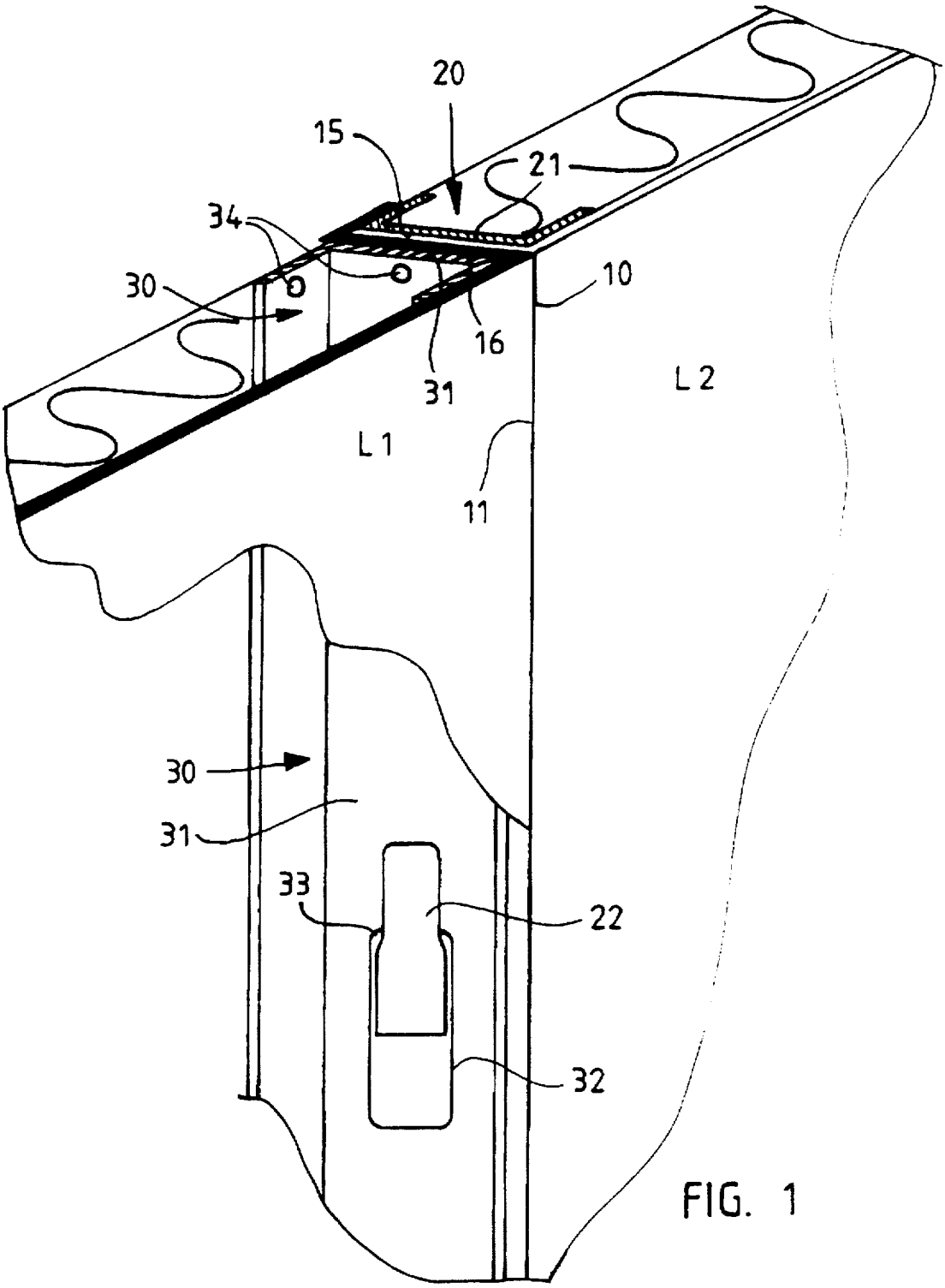
Figure 2A:
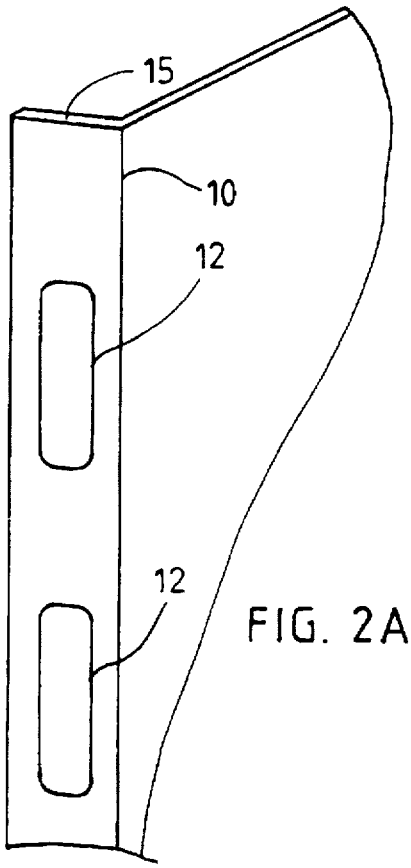
Figure 2B:
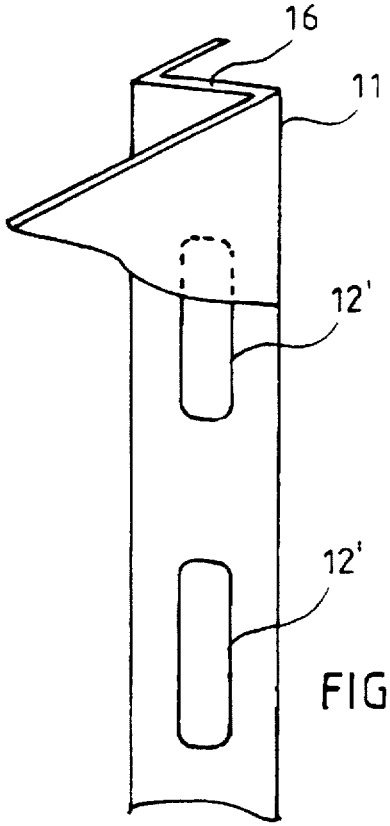
Figure 3:
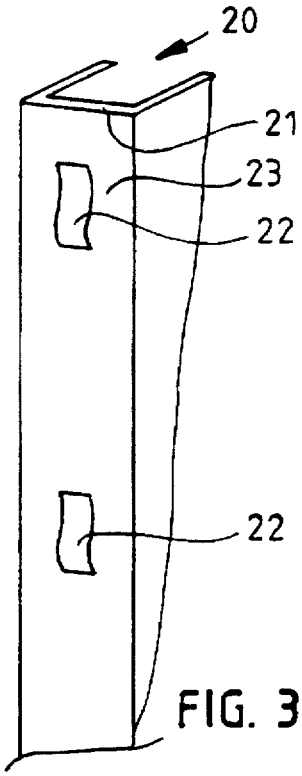
Figure 4:
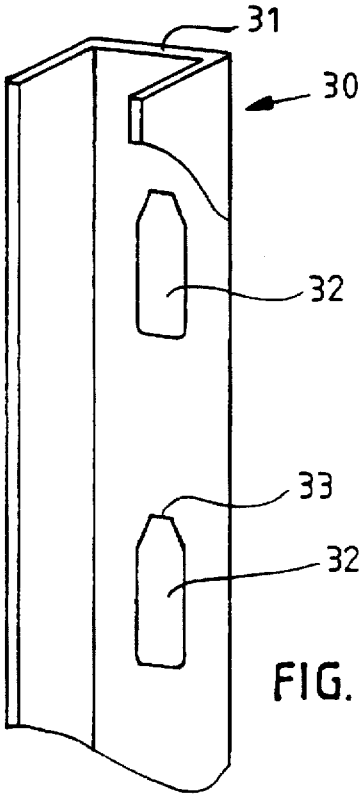
Figure 5:
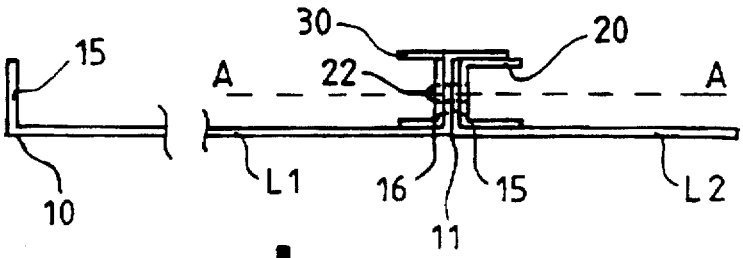

FIGS. 1 and 5 show the attachment of adjacent wall panels L1 and L2 to each other. The first side edge 10 of the panel L1 is bent into an L-section and the second side edge 11 is bent into a Z-section. The bent L- and Z-sections are provided with holes 12, 12' respectively at a suitable interval from each other over the height of the wall panel in the manner shown in FIGS. 2A and 2B. The edges of the second panel L2 are bent in the same way. The L- and Z-sections of the panel L2 are also provided with holes 12, 12' respectively disposed in the same way as those of the panel L1 over the height of the wall panel. Thus the holes 12, 12' of the edge sections of both panels come opposite one another when the panel L1 is placed adjacent to the panel L2. The L-section of the second panel L2 is placed against the Z-section of the first panel L1 according to FIGS. 1 and 5. The perforated part 15 of the L-section of the second panel presses against the similarly perforated part 16 of the Z-section of the first panel. A tongue strip 20 with a U-profile, the structure of which appears in more detail in FIG. 3, is attached against the L-section of the panels by gluing or riveting, for example. The middle part 21 of the U-section of the tongue strip 20 is provided with upward pointing tongues 22 over the height of the strip. The tongues 22 are dimensioned and fitted so that the tongues go through both holes 12, 12' of the edge sections 15, 16 of the panels L1 and L2 placed side by side. A wedge strip 30 with a U-profile, the structure of which appears in more detail in FIG. 4, is placed against the Z-section of the panel L1. The middle part 31 of the U-shaped section of the wedge strip is provided with holes 32 over the height of the strip which are shaped and dimensioned so that the tongues 22 go through the holes 32 when the wedge strip is placed against the Z-section. The panels L1 and L2 are attached to each other by knocking the wedge strip 30 downwards whereupon the upper edges 33 of the holes 32 go into the pockets 23 formed by the tongues 22, preferably up to the bottom of the pockets. The location of the holes 32 of the wedge strip must, of course, be such that the strip can be knocked down in this way. Viewing from above, perforation of the wedge strip starts so that the upper edge 33 of the first hole is at the same height as the bottom of the pocket 23 of the first tongue. By means of the wedge strip the panels can be attached to each other and aligned correctly in place.

Naturally, the tongue strip can be attached to the L-section of the panel on the building site but assembly is quickened if the strip is pre-attached to the L-section of the panel already in the factory. To obtain a joint between the panels which is as tight as possible, the tongue strip must be firmly attached to the L-section.

Naturally, the wedge strip cannot be permanently fixed to the Z-section of the panel in the factory because assembly requires that the strip can be moved in the vertical direction. However, it is preferable if the wedge strip is temporarily attached against the Z-section by light gluing or by other means. It must be attached to the edge section 16 of the panel so that the tongues 22 go through its holes 32 when two panels are placed side by side. According to an advantageous solution, the wedge strip is temporarily fixed to the edge section 16 so that it extends a tongue-length above the panel itself. When knocked down its upper edge will be at the same height as the panel.

The upper edge of the wedge strip 30 is suitably provided with holes 34 into which a locking member can be fitted. When the wall is being disassembled, a suitable tool can be fitted into the holes 34 to lift the strip up whereupon the panels release from each other.

According to an advantageous embodiment, the holes 32 of the wedge strip narrow upwards as shown in FIG. 4. In this way a better attachment is obtained.

The tongue strip 20 is suitably fabricated so that the tongues 22 are punched out of the middle part 21 of the U-section and are bent in a desired fashion.

Figure 6:
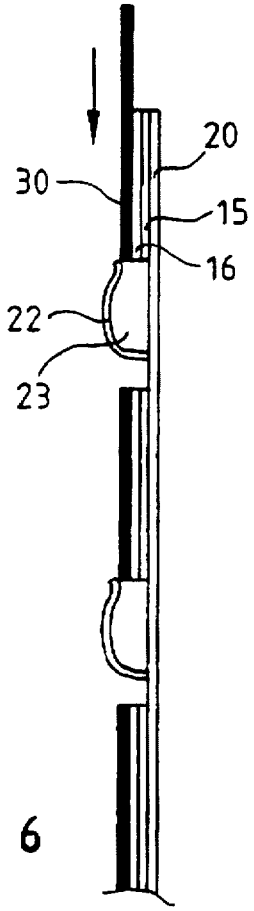
Figure 7:
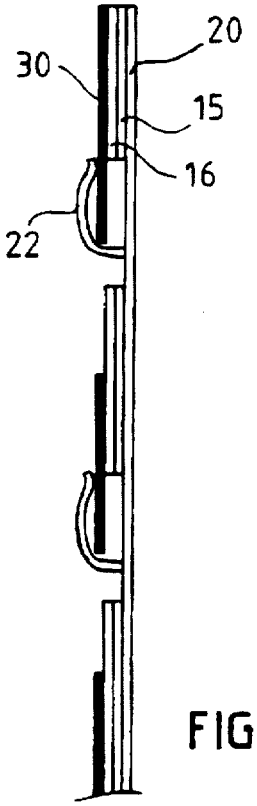

FIG. 6 shows the location of the wedge strip when it is temporarily fixed to the part 16 of the Z-section. By forcing the strip downwards in the direction of the arrow, one obtains the locking shown in FIG. 7.

Figure 8:
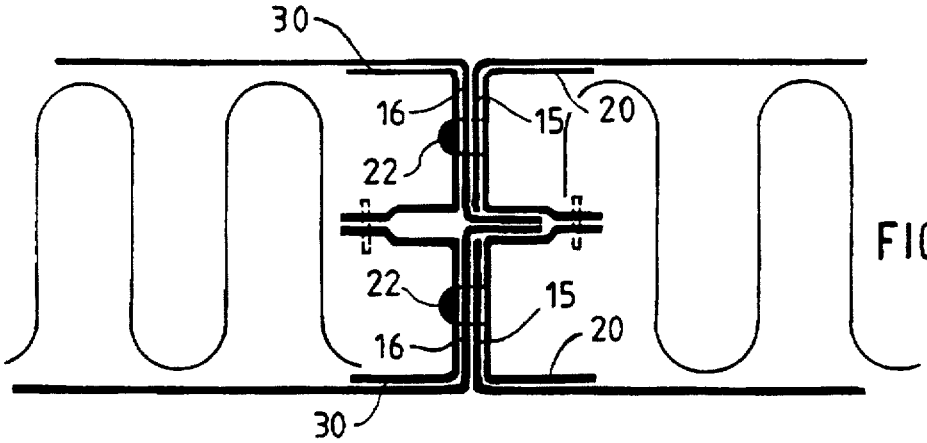

The attachment method described above is particularly suitable for the assembly of metal-plate partition walls used in shipbuilding. Insulation can be fitted inside the plates. The plates can be placed against each other in the way shown in FIG. 8 to make up a double thickness. Adjacent tongue strips and adjacent wedge strips are coupled to each other so that the wall structure is compact also in the direction of width. The U-sections of the tongue strip and the wedge strip are shaped so that there is enough space for the outermost flanges of the Z-sections of the panels.

It is obvious to a specialist in the field that the different embodiments may vary within the limits of the enclosed claims.

I claim:

1. Method for attaching wall panels to each other with the wall panels positioned in side by side relation, the wall panels including a first wall panel having a side edge bent into a Z-section and a second side panel having a side edge bent into an L-section, the bent L-section and the bent Z-section being provided with holes at spaced intervals over a height of the wall panels, the method comprising:

placing the panels side by side by fitting the Z-section of the first panel against the L-section of the second panel so that the holes in the first and second panels are positioned opposite one another;

fitting a U-shaped tongue strip against the L-section of the second panel, the tongue strip having a middle part provided with upwardly oriented tongues extending over a height of the tongue strip, the tongue strip being fitted against the L-section of the second panel so that the tongues pass through the holes of both wall panels;

fitting a U-shaped wedge strip against the Z-section of the first panel, the wedge strip having a middle part provided with holes extending over a height of the wedge strip, the wedge strip being fitted against the Z-section of the first panel so that the tongues pass through the holes in the wedge strip; and urging the wedge strip downwardly so that upper edges of the holes in the wedge strip are positioned in pockets formed by the tongues to thereby attach the panels to each other.

2. Method according to claim 1, wherein the tongue strip is attached to the L-section of the second panel.

3. Wall element comprising:

a first wall panel having one side edge bent into a Z-section and provided with a plurality of holes at spaced intervals along a height of the first wall panel;

a second wall panel having one side edge bent into an L-section and provided with a plurality of holes at spaced intervals along a height of the second wall panel, the first and second panels being placed in side by side relation so that the Z-section of the first panel is fitted against the L-section of the second panel and with the holes in the first and second panels positioned opposite one another;

a U-shaped tongue strip fitted against the L-section of the second panel, the tongue strip having a middle part provided with upwardly oriented tongues extending over a height of the tongue strip, the tongues passing through the holes in the first and second panels; and a U-shaped wedge strip fitted against the Z-section of the first panel, the wedge strip having a middle part provided with holes arranged along the height of the wedge strip, the tongues in the tongue strip passing through the holes in the wedge strip.

4. Wall element according to claim 3, wherein upper edges of the holes in the wedge strip are received in pockets formed by the tongues.

5. Wall element according to claim 3, wherein the wedge strip is attached to an edge section of the first panel so that the wedge strip extends a tongue-length higher than the panel itself.

6. Wall element according to claim 3, wherein the wedge strip includes an upper edge provided with holes to permit the wedge strip to be locked or released.

7. Wall element according to claim 3, wherein the holes in the wedge strip narrow upwards.

8. Wall element according to claim 3, wherein the tongues are strips punched out of the middle part of the U-shaped section and bent.

9. Wall element according to claim 3, including an insulating material fitted inside the first panel.

10. Wall element according to claim 4, wherein the wedge strip includes an upper edge provided with holes to permit the wedge strip to be locked or released.

11. Wall element according to claim 4, wherein the holes in the wedge strip narrow upwards.

12. Wall element according to claim 5, wherein the holes in the wedge strip narrow upwards.

13. Wall element according to claim 4, wherein the tongues are strips punched out of the middle part of the U-shaped section and bent.

14. Wall element according to claim 5, wherein the tongues are strips punched out of the middle part of the U-shaped section and bent.

15. Wall element according to claim 4, including an insulating material fitted inside the first panel.

16. Wall element according to claim 5, including an insulating material fitted inside the first panel.

* * * * *